US007235013B2

(12) United States Patent
Kobayashi

(10) Patent No.: US 7,235,013 B2
(45) **Date of Patent: *Jun. 26, 2007**

(54) GAME MACHINE USING SELF-PROPELLED MEMBERS

(75) Inventor: Yusuke Kobayashi, Tokyo (JP)

(73) Assignee: Konami Corporation, Tokyo (JP)

( * ) Notice: Subject to any disclaimer, the term of this patent is extended or adjusted under 35 U.S.C. 154(b) by 1190 days.

This patent is subject to a terminal disclaimer.

(21) Appl. No.: 10/001,958

(22) Filed: Dec. 5, 2001

(65) Prior Publication Data

US 2004/0235571 A1 Nov. 25, 2004

(30) Foreign Application Priority Data

| | | |
|---|---|---|
| Dec. 7, 2000 | (JP) | P.2000-373280 |
| Dec. 8, 2000 | (JP) | P.2000-374321 |
| Jan. 22, 2001 | (JP) | P.2001-013726 |
| Jan. 22, 2001 | (JP) | P.2001-013747 |

(51) Int. Cl.
*A63F 13/00* (2006.01)
*A63F 9/24* (2006.01)

(52) U.S. Cl. ..... 463/61; 463/59; 463/60; 463/62; 463/63; 463/64; 463/65; 446/135; 446/136; 446/444; 446/446; 446/454; 446/455; 446/456; 446/175

(58) Field of Classification Search ..... 446/444, 446/446, 454–456, 135–136; 463/6–7, 58–65
See application file for complete search history.

(56) References Cited

U.S. PATENT DOCUMENTS

| | | | | |
|---|---|---|---|---|
| 3,224,771 | A * | 12/1965 | Altieri | 463/64 |
| 4,066,021 | A * | 1/1978 | Helm | 104/138.1 |
| 4,618,271 | A * | 10/1986 | Li | 384/461 |
| 5,472,192 | A * | 12/1995 | Eto | 463/6 |
| 5,601,490 | A * | 2/1997 | Nakagawa et al. | 463/63 |

FOREIGN PATENT DOCUMENTS

| | | | |
|---|---|---|---|
| JP | 6-74191 | U | 10/1994 |
| JP | 9-28922 | A | 2/1997 |
| JP | 2634069 | B2 | 4/1997 |
| JP | 9-261944 | A | 10/1997 |
| JP | 09261944 | A * | 10/1997 |

* cited by examiner

*Primary Examiner*—Scott Jones
*Assistant Examiner*—Ryan Hsu
(74) *Attorney, Agent, or Firm*—Sughrue Mion, PLLC

(57) ABSTRACT

In a game machine, platen dots are provided on a traveling field. A plurality of self-propelled members are provided on the traveling field. Each self-propelled member includes a first linear motor and a second linear motor for respectively propelling the self-propelled member in a first direction and a second direction perpendicular to each other. A miniature member is coupled with a motor so as to be rotatably supported on each self-propelled member. A controller controls the motor such that a rotated angle of the miniature member is determined in accordance with a propelling direction of the self-propelled member.

44 Claims, 13 Drawing Sheets

GAME MACHINE USING SELF-PROPELLED MEMBERS

BACKGROUND OF THE INVENTION

The present invention relates to a game machine using self-propelled members, which facilitates travel control of the self-propelled members, significantly simplifies a mechanical structure and control system of the game machine, and significantly curtails manufacturing costs.

A travel driving mechanism of a self-propelled member used in a racing game machine basically drives wheels by a rotary drive motor and effects turning action by controlling a rotational speed differential between the left driving wheel and the right driving wheel. Japanese Patent No. 2650643 discloses an example of such a racing game machine. Further, Japanese Patent Publication No. 7-68056A describes an example of such a play game machine. In the racing game machine, a racing track is formed into a two-story structure in which self-propelled members are caused to travel on a traveling field to attractively guide miniatures which are incapable of self-propelling are caused to race with each other on a racing track by way of magnetic force originating from magnets. In the play game machine, miniatures are provided on the respective self-propelled members. The self-propelled members are caused to travel, thus causing the miniatures to play a game.

Electrical wires are arranged in the X and Y directions densely on a plane on which the self-propelled members travel (hereinafter called as traveling field). The electrical wires serve as position detecting wires to detect traveling positions of the self-propelled members. On the basis of detected position information, the self-propelled members are subjected to feedback control, thereby implementing trackless travel. A known position detecting method includes the steps of: capturing a self-propelled member by a CCD camera, subjecting the thus-captured image to image processing, and detecting a traveling position of the self-propelled member on a virtual traveling field through computation.

Nowadays, the information processing speed of a microcomputer and the information storage capacity of memory have been remarkably improved. Against this backdrop, feedback control of travel of a self-propelled member on the position detecting information is comparatively easy in terms of technique.

However, in an actual racing game machine, a self-propelled member travels through use of driving wheels. As a result of slippage, the member may be thrown into a skid and deviate from a racing track, become greatly deviated from a desired direction, or overturn. Thus, feedback control poses a problem in the accuracy of control of a traveling route, in the response of correction of a traveling direction of a self-propelled member, and in the response of correction of a track of the self-propelled member. In reality, unexpected racing is effected often. Thus, difficulty is encountered in causing self-propelled members to race with each other as planned.

On the premise that self-propelled members would cause slippage and deviate from tracks, a plurality of self-propelled members are simultaneously controlled so as to travel by effecting feedback control on the basis of position detecting information while correction is made to movement of the self-propelled members. In this case, a control system and a control program become complicated.

Even in the case of a member which travels, drives, and turns by frictional force developing between wheels and a travel face, it is theoretically conceivable that the member effects feedforward control instead of feedback control on the basis of position detecting information. It is readily predicted that a travel control program for the member and design thereof would be simple. Considerable difficulty is encountered in causing a plurality of self-propelled members in a game machine to accurately travel along predetermined traveling paths through feedforward control. Causing self-propelled members to race with each other in a racing game machine through such feedforward control as planned is almost impossible.

In relation to travel control operation based on feedback control as described the above, the traveling position of a self-propelled member is detected successively, and arithmetic operation is performed on the basis of the thus-detected position so that the traveling is controlled in accordance with a predetermined program. However, in such a configuration, a position sensor, an information processing system, and a travel control system are complicated and involve considerably high manufacturing costs.

Furthermore, conformity exists between motion of a miniature and that of a self-propelled member. Hence, the orientation of a miniature cannot be changed quickly. Consequently, it is impossible to implement a game machine involving quick changes in motions of miniatures; for example, a soccer game machine and a play game machine which effects dancing involving spinning.

SUMMARY OF THE INVENTION

The present invention is aimed at putting considerable thought into the mechanical structure and travel control mechanism of a self-propelled member, by thoroughly changing a travel driving unit and travel control method of a self-propelled member provided in a game machine, by causing a miniature to smoothly and accurately travel along a predetermined traveling path and by quickly changing the orientation of the miniature, while controlling travel of a self-propelled member without use of position detecting information.

In order to achieve the above object, according to the present invention, there is provided a game machine, comprising:

a traveling field, on which platen dots are provided; and a plurality of self-propelled members, which are provided on the traveling field, each including:

- a first yoke, which constitutes a first linear motor together with the platen dots for propelling the self-propelled member in a first direction on the traveling field;
- a second yoke, which constitutes a second linear motor together with the platen dots for propelling the self-propelled member in a second direction which is perpendicular to the first direction;
- a motor;
- a miniature member, which is coupled with the motor so as to be rotatably supported on the self-propelled member; and
- a controller, which controls the motor such that a rotated angle of the miniature member is determined in accordance with a propelling direction of the self-propelled member.

According to the present invention, there is also provided a racing game machine, comprising:

a racing track, on which platen dots are provided;

a traveling field extending below the racing track;

a plurality of miniature members, which are provided on the racing track to be raced with each other, each miniature member provided with a magnetic substance; and a plurality of self-propelled members, which are provided on the traveling field while being associated with the respective miniature members, each self-propelled member including:

a first yoke, which constitutes a first linear motor together with the platen dots for propelling the self-propelled member in a first direction on the traveling field;

a second yoke, which constitutes a second linear motor together with the platen dots for propelling the self-propelled member in a second direction which is perpendicular to the first direction;

a guide magnet, which constitutes a torque transmission coupling with the magnetic substance of the associated miniature member;

a motor, which rotates the guide magnet so as to turn a posture of the associated miniature member via a magnetic force; and a controller, which controls the motor such that a rotated angle of the guide magnet is determined in accordance with a propelling direction of the self-propelled member.

In this configuration, controlling power supplied to the first and the second yokes to constitute a planar linear motor, the self-propelled member can be propelled on the two-dimensional traveling field or racing track at an arbitrary speed and in an arbitrary direction while orienting in a certain direction.

On the other hand, the miniature member is oriented by the torque transmission coupling so as to match with the propelling direction of the self-propelled member, so that miniatures can be caused to race or play with each other in natural postures.

In principle of the planar linear motor, the self-propelled member actually travels as if tracing a kinked line (or in a stepped manner). However, in reality, one step of the self-propelled member in the first and the second directions when traveling obliquely can be made considerably minute. Hence, the self-propelled member is viewed as if traveling substantially linearly. The same also applies to a case where the self-propelled member turns its traveling direction.

Since the miniature is towed by the self-propelled member by the motor directly or via the magnetic force, the miniature turns its direction with a slight time lag so as to follow turning action of the self-propelled member. The traveling direction of the miniature is smoothed by an amount corresponding to the time lag. As a result, the miniature travels along a path which is apparently curved. Hence, the miniature travels linear in an oblique line and travels along a predetermined path while smoothly turning a direction in a curved manner.

Since the self-propelled member is driven to travel by a planar linear motor, the self-propelled member travels along a predetermined path accurately and without fail. Consequently, the self-propelled member can be caused to travel along a predetermined path accurately through feedforward control without use of travel position detecting information. Accordingly, the travel control system can be simplified, thereby greatly curtailing manufacturing costs of a game machine using self-propelled members.

Preferably, ball bearings are provided on a bottom face of the self-propelled member to assist the propelling on the traveling field.

Since a ball bearing has no directionality when rotating, the self-propelled member can smoothly slide in every direction within the X-Y plane on the traveling field.

Here, it is preferable that the ball bearings are composed of at least three independent ball bearings.

Alternatively, it is preferable that the ball bearings are supported within an annular holder formed on the bottom face of the self-propelled member to constitute a thrust bearing.

Alternatively, it is preferable that nozzles from which air is blown toward a bottom face of the self-propelled member are formed on the traveling field to form an air bearing layer between the bottom face and the traveling field to support the self-propelled member thereon.

In this configuration, the self-propelled member is supported by an air bearing constituted of a thin air layer. The self-propelled member travels over the traveling field while slightly being supported and levitated by the air layer. Consequently, traveling resistance of the self-propelled member is diminished. The self-propelled member can travel freely by small traveling and driving force originating from the planar linear motor.

Here, it is preferable that a skirt member is formed on a peripheral portion of the bottom face of the self-propelled member.

In this configuration, the skirt member effectively captures an air flow blown from the nozzles formed on the traveling field. Hence, the self-propelled member can be slightly levitated from the travel face by a relatively weak air flow from the nozzles.

Alternatively, it is preferable that the self-propelled member includes a compressor for blowing compressed air toward the traveling field through nozzles formed on a bottom face thereof, to form an air bearing layer between the bottom face and the traveling field to support the self-propelled member thereon.

In this configuration, a construction for creating an air bearing for supporting individual traveling members in a freely-movable manner is simple. The amount of required compressed air is minimal, and the influence of sprayed compressed air to other elements is minimized.

Preferably, each of the first yoke and the second yoke is formed with three legs provided with coils, to constitute three-phase linear motors.

Since three-phase planar linear motor enables smooth travel of the self-propelled member without involvement of stepping-out, the miniature can be traveled more smoothly.

Here, it is preferable that a lower end portion of each leg is split into plural projections each having an identical width with a width of each platen dot.

In this configuration, the driving force of each yoke can be increased, thus improving the accuracy of travel control to a much greater extent.

Preferably, the motor is a pulse motor. In this configuration, control of turning action of a miniature member can be performed through feedforward control. Thus, control of orientation of the miniature can be performed accurately, quickly, and simply. As a result, the travel controller and control program of the self-propelled member can be made considerably simple.

In the case of the racing game machine, it is preferable that each of the guide magnet of the self-propelled member and the magnetic substance of the miniature member is composed of arcuate N-pole magnets and arcuate S-pole magnets which are arranged alternately and annularly.

Alternatively, it is preferable that the magnetic substance of the miniature member is divided magnetic poles forming an induced magnet.

Further, it is preferable that the ball bearings are made of metal, and a conductive layer is formed on the traveling field for supplying power to the linear motors of the self-propelled member via the ball bearings.

In this configuration, the ball bearings can be utilized as power supply terminals, thereby simplifying the construction of a power supply mechanism.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

A travel driving unit of a self-propelled member is based on a planar linear motor. The basic mechanism and operation principle of the planar linear motor will be described as follows.

Figure 1:
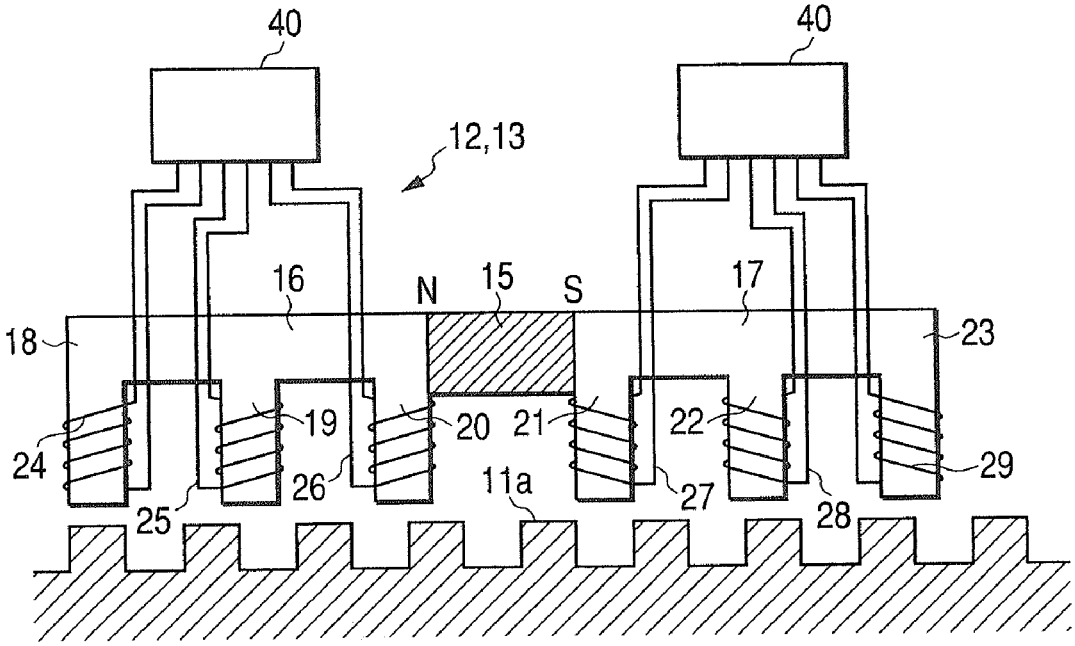
FIG. 1 is a schematic cross-sectional view showing an X-direction mobile yoke and a Y-direction mobile yoke of a three-phase planar linear motor.
Figure 2:
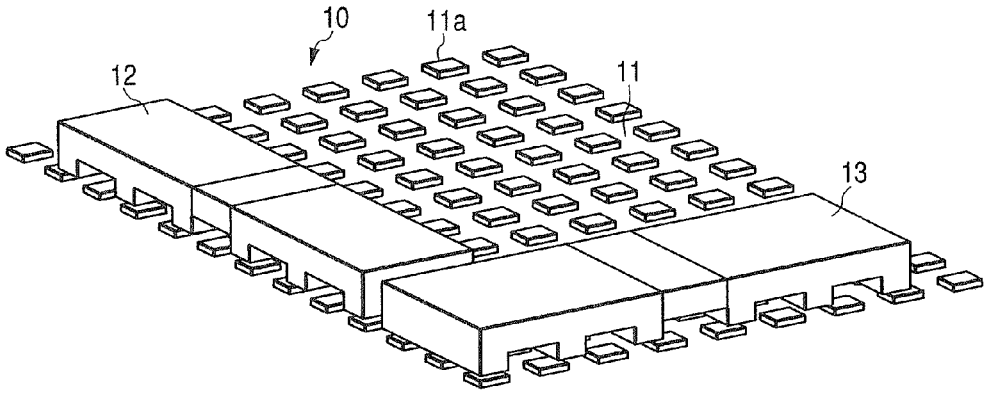
FIG. 2 is a schematic perspective view showing a platen, the X-direction mobile yoke, and the Y-direction mobile yoke.
Figure 3:
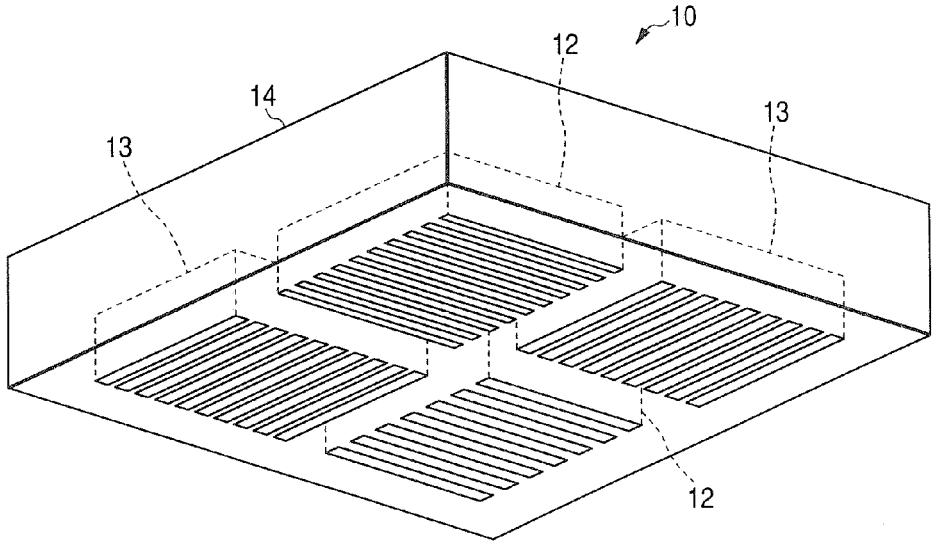
FIG. 3 is a perspective view showing a casing of the three-phase planar linear motor.

As shown in FIGS. 1 to 3, a three-phase planar linear motor 10 is provided with a platen 11 on which platen dots 11 a are provided and a casing 14 (see FIG. 3) provided so as to move freely over the platen 11. Two X-direction mobile yokes 12 for actuating the linear motor 10 in an X direction and two Y-direction mobile yokes 13 for actuating the linear motor 10 in a Y direction are accommodated in the casing 14. FIG. 2 shows the three-phase planar linear motor 10 while it is removed from the casing 14 for the purpose of convenience, where one X-direction mobile yoke 12 and one Y-direction mobile yoke 13 are illustrated. As shown in FIG. 1, the X-direction mobile yoke 12 is substantially identical in structure with the Y-direction mobile yoke 13. Each of the X-direction mobile yoke 12 and the Y-direction mobile yoke 13 is provided with a permanent magnet 15 and a pair of yokes 16 and 17 provided on both sides of the permanent magnet 15. The yoke 16 has three legs 18, 19, and 20 extending toward the platen 11, and the yoke 17 has three legs 21, 22, and 23 extending toward the platen 11. Each width of the legs 18, 19, 20, 21, 22, and 23 is substantially identical with a width of the platen dots 11*a*.

A U-phase coil 24 is coiled around the leg 18; a V-phase coil 25 is coiled around the leg 19; and a W-phase coil is coiled around the leg 26. A three-phase current flows into the U-phase coil 24, the V-phase coil 25, and the W-phase coil 26. A U'-phase coil 27 is coiled around the leg 21; a V'-phase coil 28 is coiled around the leg 22; and a W'-phase coil 29 is coiled around the leg 23. The three-phase current flows into the U'-phase coil 27, the V'-phase coil 28, and the W'-phase coil 29.

The pitch at which the legs 18, 19, and 20 of the yoke 16 are arranged is 120° out of phase with the pitch at which the platen dots 11*a* are arranged. Similarly, the pitch at which the legs 21, 22, and 23 of the yoke 17 are arranged is 120° out of phase with the pitch at which the platen dots 11*a* are arranged. The positional relationship between the platen dots 11*a* of the legs 21, 22, and 23 is 180° out of phase with the positional relationship between the platen dots 11*a* of the legs 18, 19, and 20.

Figure 6:
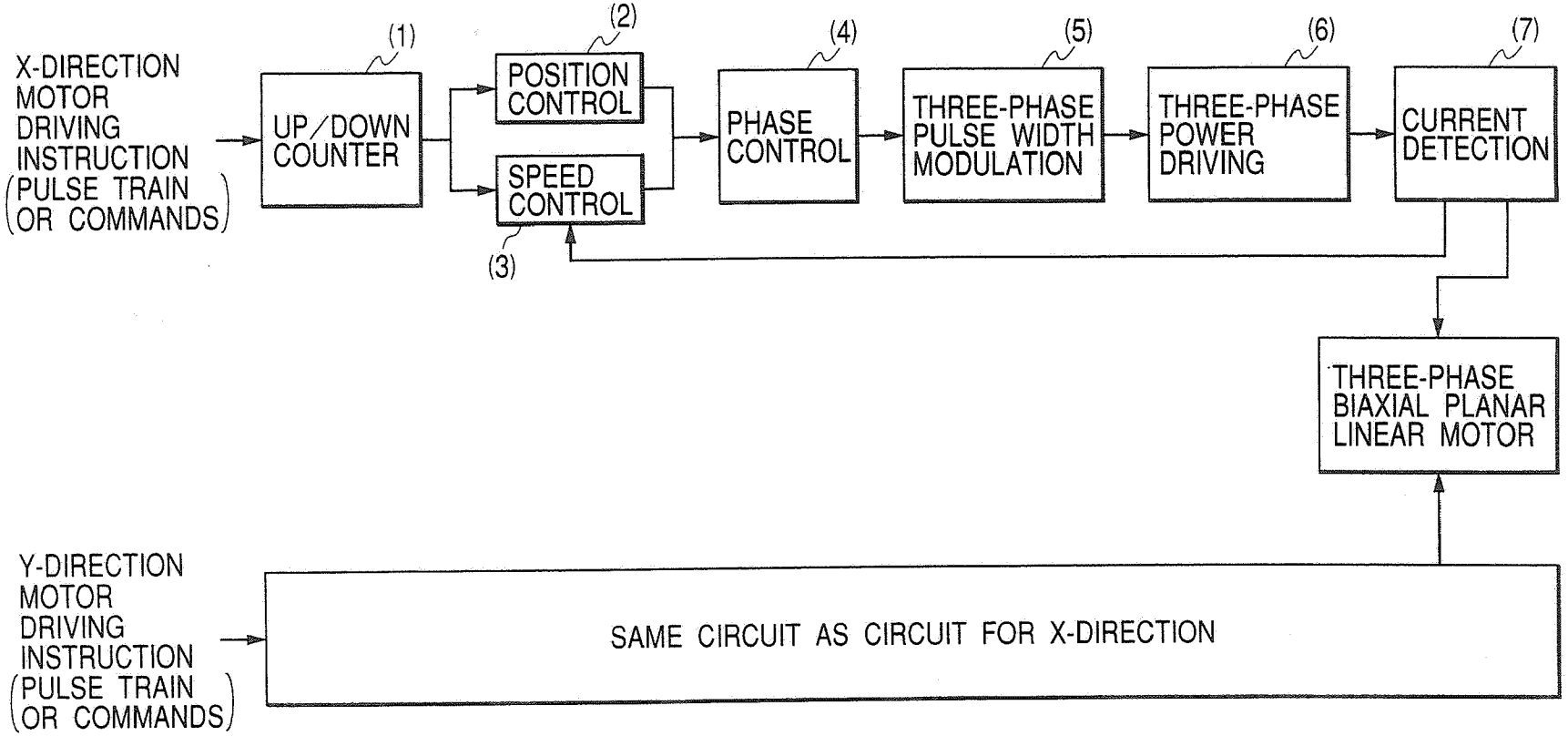
FIG. 6 is a block diagram showing a drive controller for driving the three-phase planar linear motor.
Figure 7:
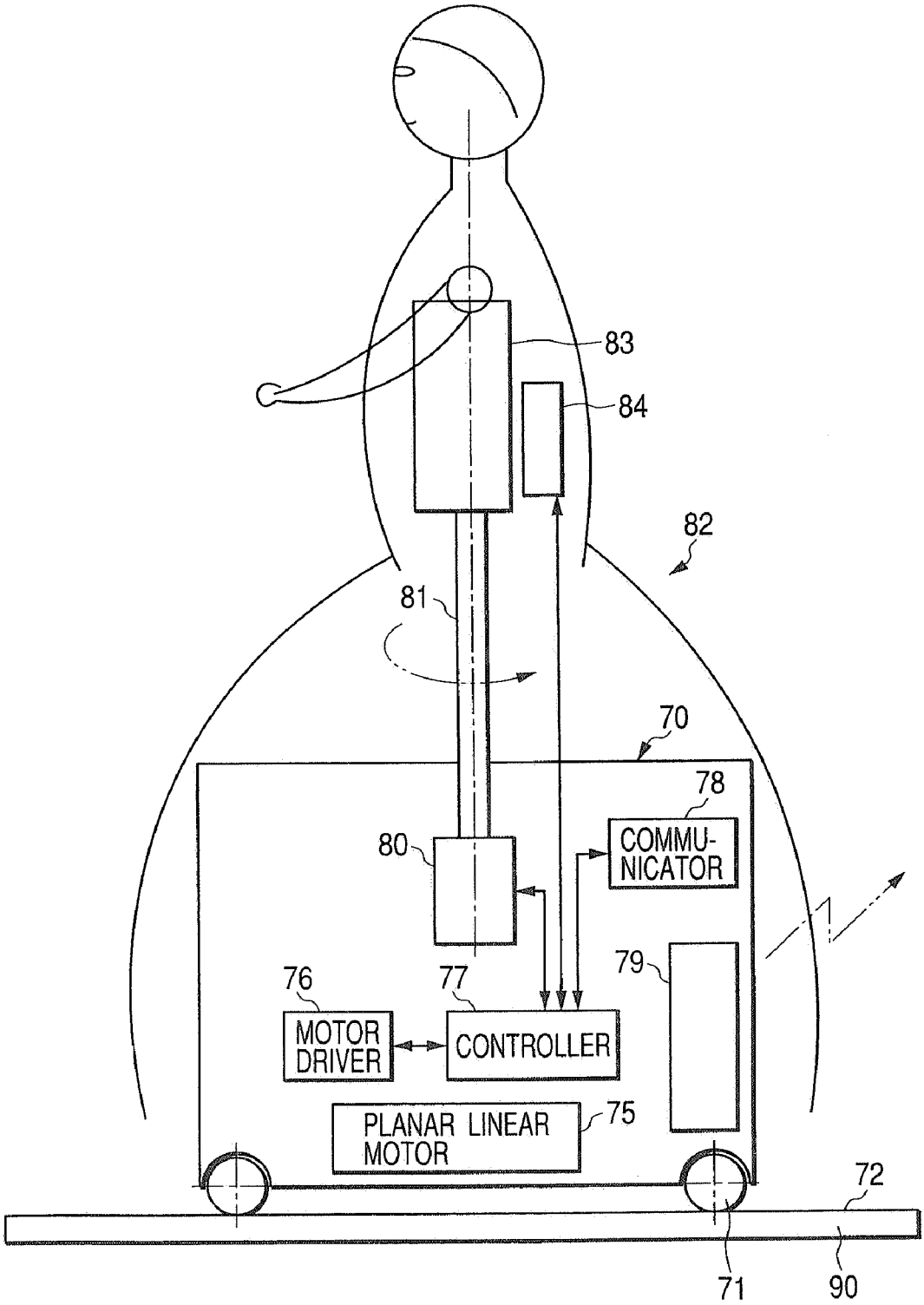
FIG. 7 is a schematic cross-sectional view showing a self-propelled member according to a first embodiment of the present invention.

As shown in FIG. 6, a planar linear motor is actuated, by inputting, into a drive controller 40, a pulse train proportional to the amount of travel.

(1) a pulse train and a moving direction are first input into an up/down counter provided in the drive controller 40 as a motor driving instruction for ascertaining an absolute position;

(2) prepare information about a position to which the self-propelled member is to travel, on the basis of a value of the counter;

(3) prepare speed information in accordance with a speed at which the counter changes;

(4) prepare a three-phase traveling waveform corresponding to the two information items;

(5) the electric current is subjected to pulse width modulation (PWM) proportional to a current to be caused to flow to each of the three-phases coils 24 through 29 (this operation is performed to prevent excessive power loss occurred in the drive controller 40 if an electric current of the waveform may be caused to flow into the three-phase coils 24 through 29);

(6) a switch circuit is controlled by a pulse-width-modulated on/off signal, thereby producing three-phase electric power;

(7) an electric current is detected so as to make pulse width modulation proportional to an output electric current, in order to shut down the self-propelled member in the event of occurrence of excessive current as a result of accidents;

In the case of command control, a commitment (command) to be input for operating a linear motor has been determined beforehand, and the linear motor is controlled through use of the command. A command analysis circuit produces a pulse train from the command in (1), and subsequent processing is identical with that mentioned above.

Next, a three-phase electric current flows from the drive controller 40 to the U-phase coil 24, the V-phase coil 25, and the W-phase coil 26 of the X-direction mobile yoke 12. Simultaneously, a three-phase electric current having the same current waveform as that flowing into the X-direction mobile yoke 12 flows into the U'-phase coil 27, the V'-phase coil 28, and the W'-phase coil 29. In this case, the three-phase electric current flowing into the U-phase coil 24, the V-phase coil 25, and the W-phase coil 26 is opposite in direction with that flowing into the U'-phase coil 27, the V'-phase coil 28, and the W'-phase coil 29. A set of three-phase current output devices enables simultaneous flow of an electric current to the U-phase coil 24, the V-phase coil 25, and the W-phase 26 and to the U'-phase 27, the V'-phase 28, and the W'-phase 29. At this time, the X-direction mobile yoke 12 undergoes horizontal driving force exerted by the platen 11 in the X direction.

In the meanwhile, air is blown against the platen 11 by way of air nozzles (not shown) provided in the casing 14. As a result, the casing 14 is levitated slightly from the platen 11. The entirety of the casing 14 is then moved in the X direction.

If inversion of movement of the casing 14 in the X direction is desired, offset phase angles of the electric currents flowing through any two coils of the U-phase coil 24, the V-phase coil 25, and the W-phase coil 26 are inverted. Further, offset phase angles of the electric currents flowing through any two coils of the U'-phase coil 27, the V'-phase coil 28, and the W'-phase coil 29 are inverted so as to correspond to those of the electric currents flowing through the U-phase coil 24, the V-phase coil 25, and the W-phase coil 26. In this way, the casing 14 can be moved back and forth in the X direction.

An electric current is caused to flow into the Y-direction mobile yoke 13 in the same manner as in the X-direction mobile yoke 12, thereby enabling back and forth movement of the casing 14 in the Y direction.

The moving direction and travel speed of the casing 14 can be controlled appropriately, by controlling the electric current flowing through the Y-direction mobile yoke 13 and the X-direction mobile yoke 12.

Figure 4:
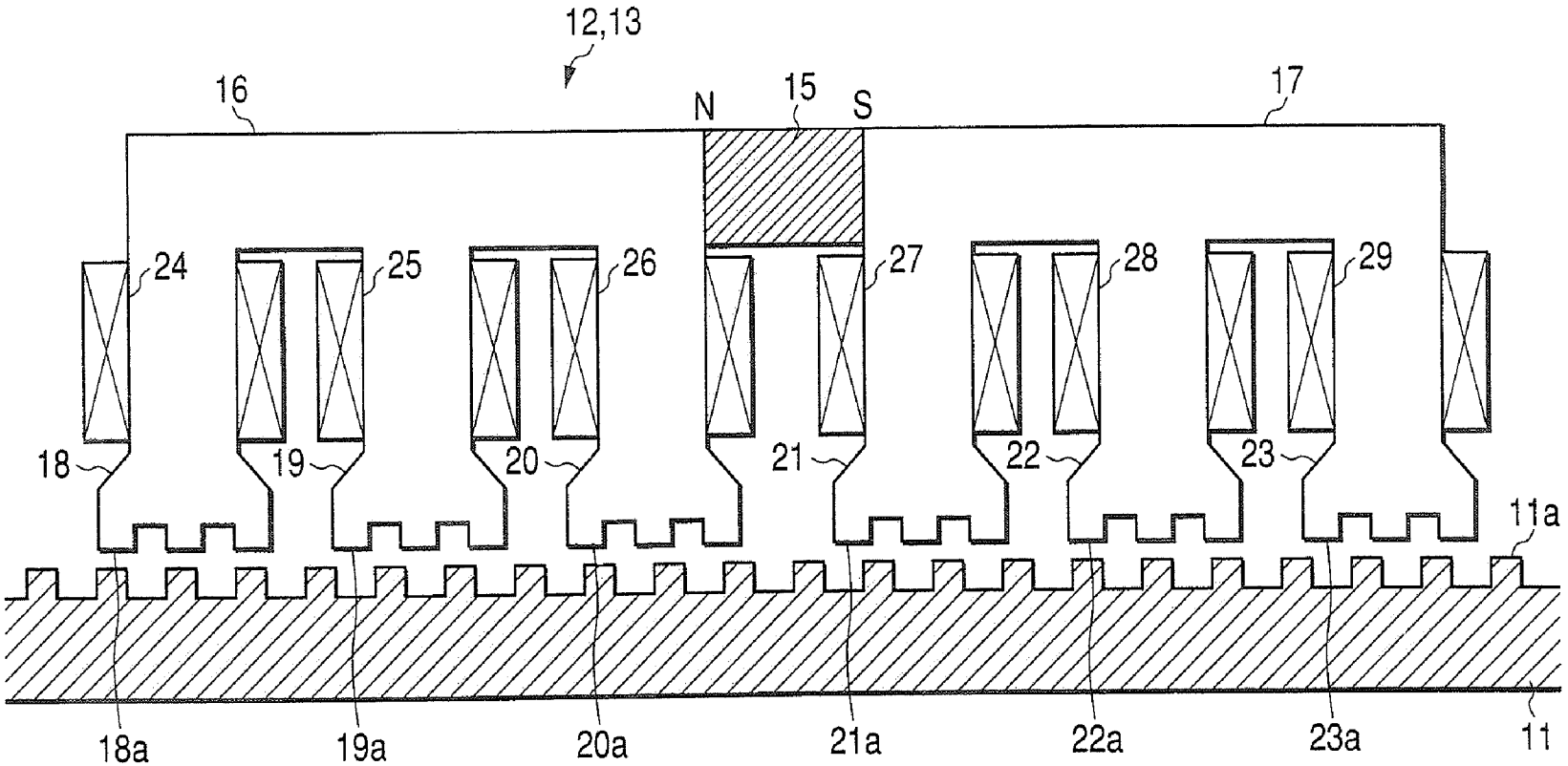
FIG. 4 is a schematic cross-sectional view showing an X-direction mobile yoke and a Y-direction mobile yoke in another example of the three-phase planar linear motor.
Figure 5:
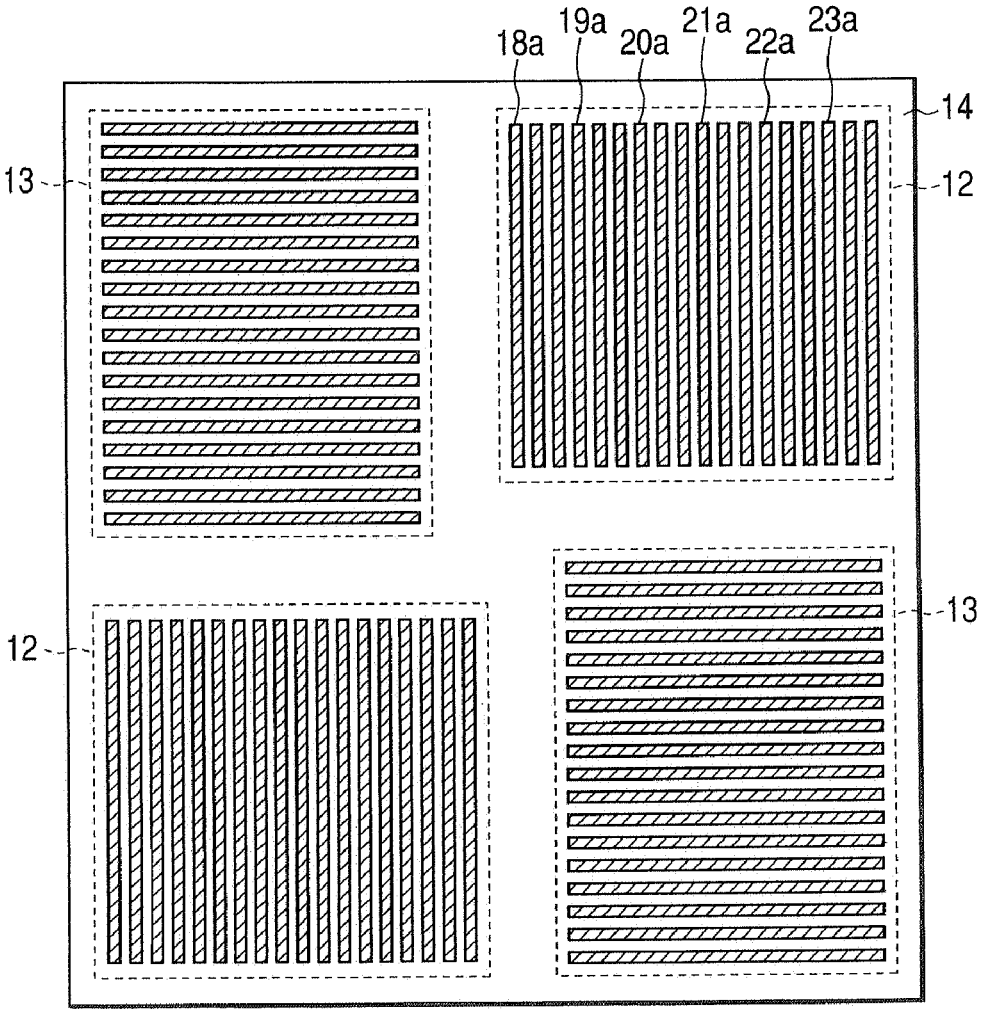
FIG. 5 is a schematic cross-sectional view showing the X-direction mobile yoke and the Y-direction mobile yoke of the three-phase planar linear motor shown in FIG. 4.

In the three-phase planar linear motor shown in FIGS. 4 and 5, the lower end of the leg 18 provided in the X-direction mobile yoke 12 is split into three sub-divisions, thereby constituting three projections 18*a*. Similarly, the lower end of the leg 19 is split into three projections 19*a*; the lower end of the leg 20 is split into three projections 20*a*; the lower end of the leg 21 is split into three projections 21*a*; the lower end of the leg 22 is split into three projections 22*a*; and the lower end of the leg 23 is split into three projections 23*a*.

In other respects, the three-phase planar linear motor shown in FIGS. 4 and 5 is identical with that shown in FIGS. 1 through 3. The platen dots 11*a* of the platen 11 are formed so as to assume the same width as that of the projection 18*a* by which the width of the leg 18 has been made narrow through separation.

Since the lower ends of the legs 18, 19, 20, 21, 22, and 23 are separated into the projections 18*a*, 19*a*, 20*a*, 21*a*, 22*a*, and 23*a*, the driving force of the X-direction mobile yoke 12 and that of the Y-direction mobile yoke 13 can be increased.

In a first embodiment of the invention, the basic mechanism and operation principle of the travel driving device of the planar linear motor are as have been described above. A travel driving device of a self-propelled member 70 according to the present embodiment is identical with that of the above-described planar linear motor. The self-propelled member 70 travels over a traveling field 90 by four ball bearings 71 (see FIG. 8). The traveling field 90 is provided with a platen 72 having the same platen dots as those shown in FIG. 2.

A planar linear motor 75 (identical with the X-direction mobile yoke 12 and the Y-direction mobile yoke 13 shown in FIGS. 4 and 5) are provided on a lower face of the self-propelled member 70. The planar linear motor 75 is activated by a motor driver 76. A controller 77 communicates a control signal with a central controller of the game machine by way of a communicator 78, whereby the motor driver 76 is controlled by the control signal output from the central controller.

A pulse motor 80 for turning purposes is provided in an upper center position of the self-propelled member 70. The pulse motor 80 controls a turning angle of a support 81, and a miniature member 82 is fixed to the upper end of the support 81. An actuator 83 for actuating a part of hands of the miniature is provided in the miniature member 82. The miniature member 82 is further provided with an actuator controller 84.

The miniature member 82 is turned by way of the support 81 by the pulse motor 80 in accordance with a change in the moving direction of the self-propelled member (i.e., turning action of the self-propelled member).

The turning angle of the pulse motor 80 is defined by a scheduled angular change in the moving direction of the self-propelled member 70 (i.e., an angle through which a self-propelled member is scheduled to turn a direction by a program in accordance with a traveling path of an individual miniature). A distance over which the self-propelled member travels in the X direction and a distance over which the self-propelled member travels in the Y direction are also defined by the scheduled angular change in the moving direction. Consequently, the angle through which the miniature 82 is turned by the pulse motor 80 matches the moving direction of the self-propelled member 70.

A way to compute the turning angle of the pulse motor 80 and the distance over which the self-propelled member 70 travels in the X and Y directions is defined in accordance with the nature of the game machine such that a control program and information processing become simple, as required.

The controller 77 may cause the pulse motor 80 to turn through a predetermined angle by an instruction output from the central controller of the game machine. A turning angle of the pulse motor 80 may be computed from the X-direction motor driving instruction signal and the Y-direction motor driving instruction signal (see FIG. 6) for controlling the travel of the self-propelled member. The pulse motor 80 may be driven on the basis of a computation result.

The self-propelled member travels in an arbitrary direction within the X-Y plane without changing its posture (i.e., a front face thereof still directs frontward). The miniature 82 is guided in the same direction as that in which the self-propelled member 70 is moving. On the other hand, the miniature 82 is turned to the guide direction by turning action of the pulse motor 80. Consequently, the miniature member 82 is turned to and runs in the moving direction of the self-propelled member 70.

When the self-propelled member 70 is a self-propelled member of a play game machine, there is a necessity of moving portions of hands and legs of the miniature member 82. In this case, the actuator controller 84 controls the actuator 83 to actuate hands or the like in accordance with a control signal output from the controller 77 of the self-propelled member 70.

The actuator 83 may be provided on the self-propelled member 70, and portions of a miniature 82, such as hands, may be actuated via a link and a belt. However, in this case, the miniature cannot be caused to spin. When there is a necessity of causing the miniature to spin, such a configuration cannot be employed.

Figure 9:
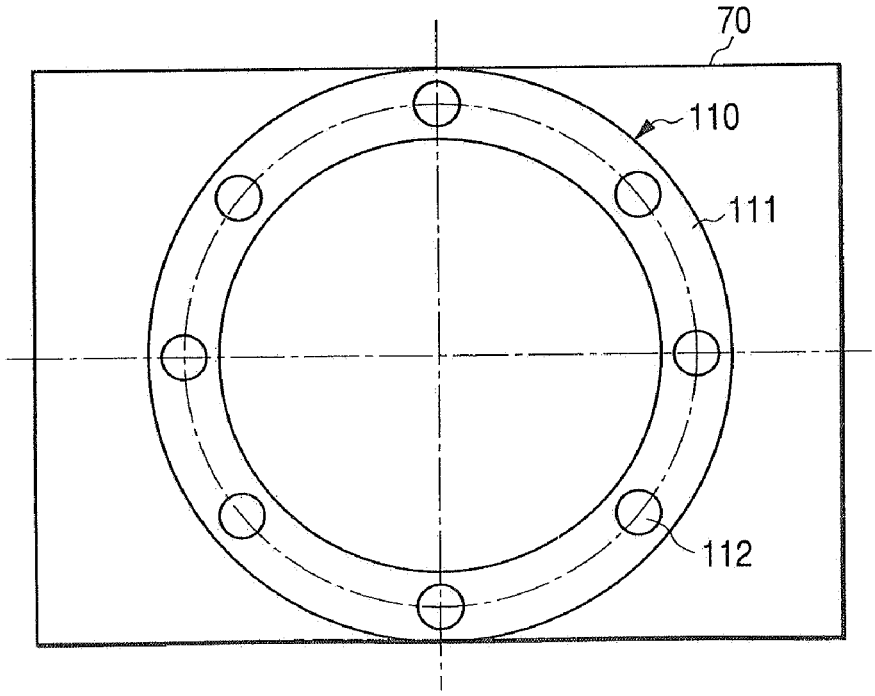
FIG. 9 is a plan view showing another example of the layout of ball bearings.

Ball bearings of the self-propelled member 70 are made of metal. In order to diminish rotational resistance between the ball bearings and an interior face of a retaining section, the balls are held in the retaining section such that linear or point contact exists between the balls and the retaining section. As shown in FIG. 9, a so-called thrust bearing 110 constituted by holding a plurality of balls 112 in an annular retainer 111 can be provided on a lower surface of the self-propelled member 70.

In the case of metal ball bearings, the ball bearings can be utilized as power collector.

Figure 10:
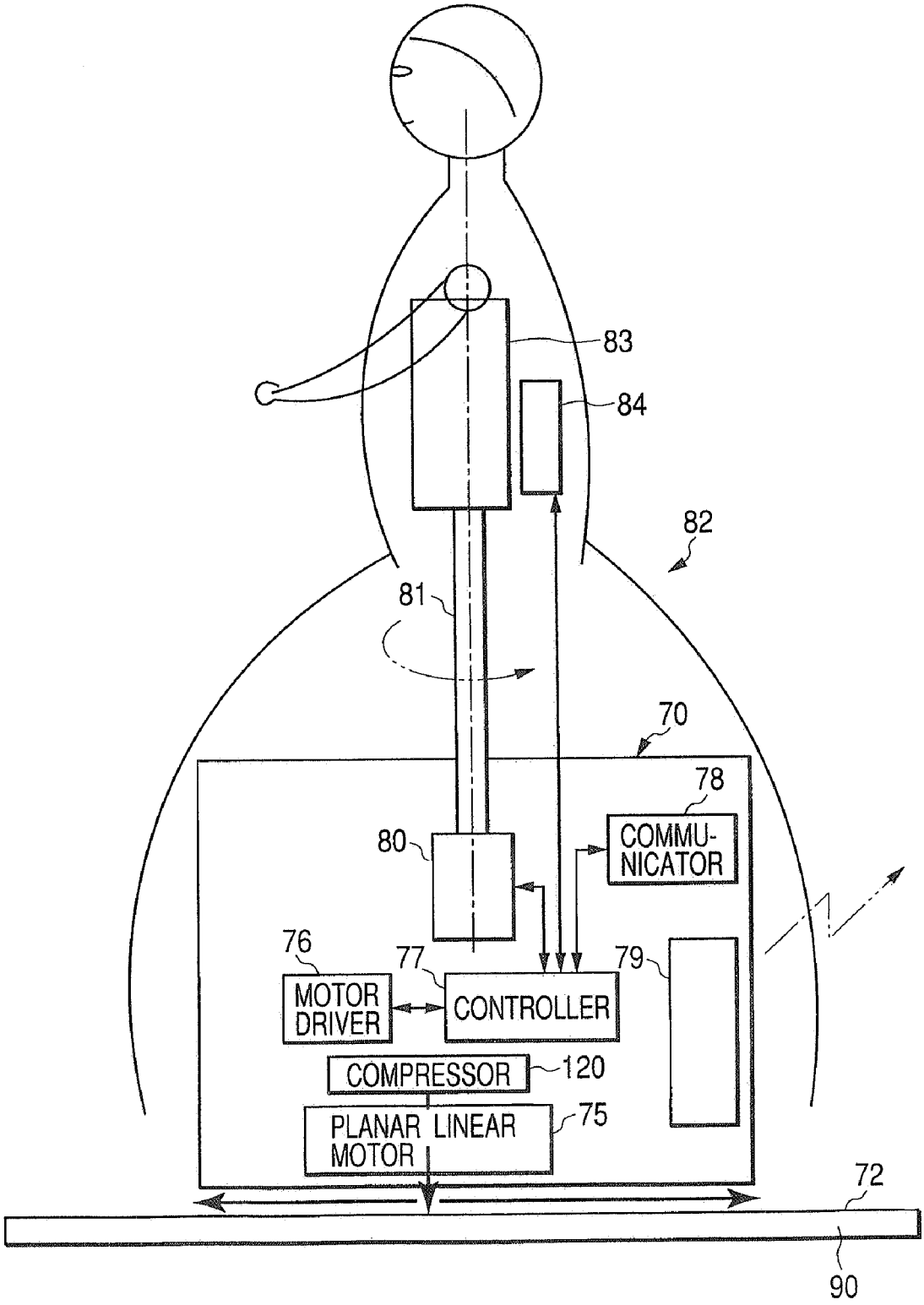
FIG. 10 is a schematic cross-sectional view showing a self-propelled member according to a second embodiment of the invention and FIG. 10A illustrates an embodiment where self-propelled member is supported by an air layer.
Figure 10A:
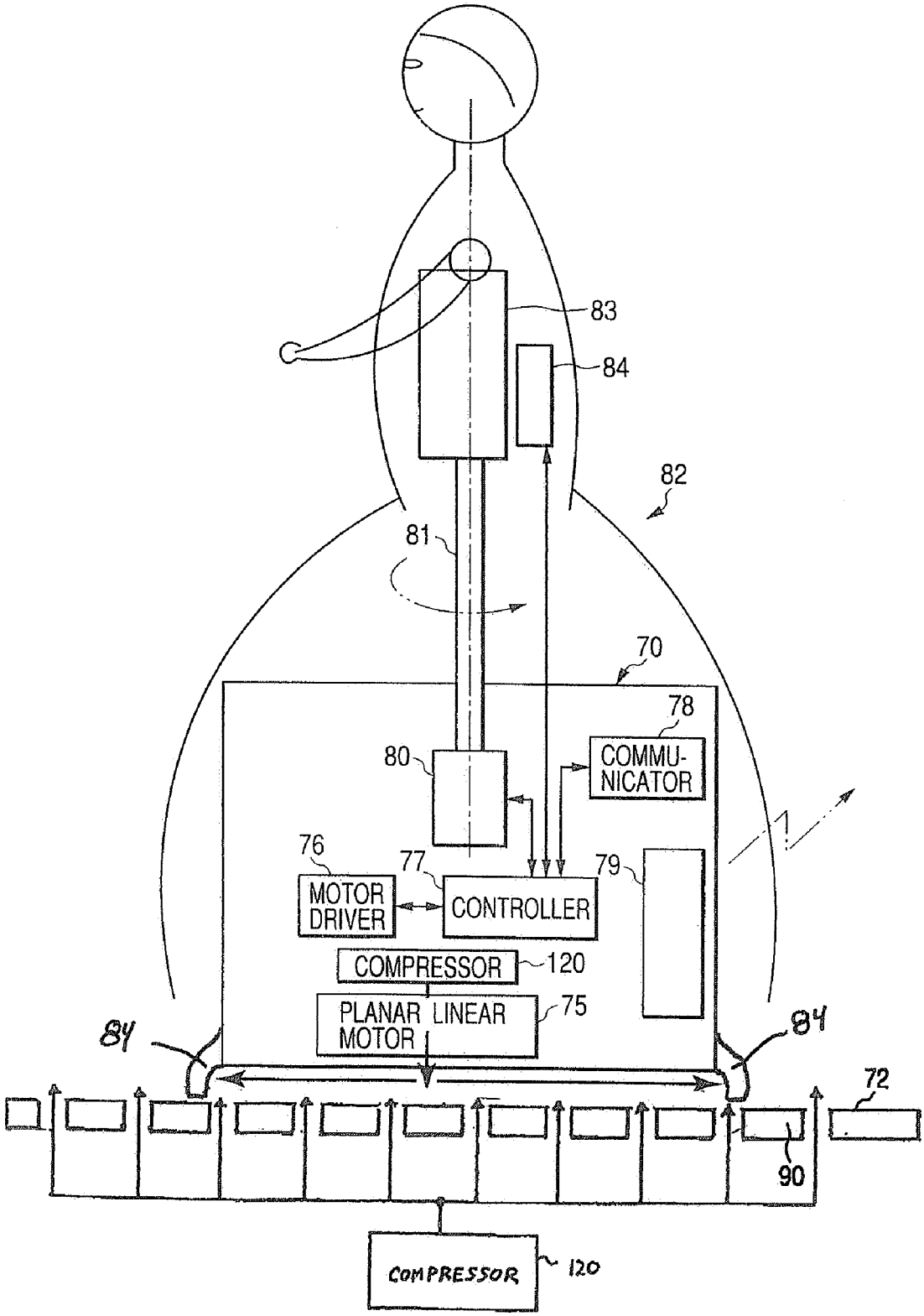

FIG. 10 shows a second embodiment in which an air bearing is adopted and FIG. 10A illustrates an embodiment of the moving member supported by the air bearing. In this embodiment, a compact compressor 120 is mounted on a self-propelled member 70, and the compact compressor 120 causes compressed air to blow by way of a nozzle formed in substantially the center of the lower face of the self-propelled member 70. The air is caused to flow in every direction along the lower face of the self-propelled member 70. A thin air layer (having a thickness of e.g., tens of microns) is formed between the self-propelled member 70 and a traveling face (i.e., the face of the platen 72). The self-propelled member is supported by the air layer. Since slide resistance existing between the self-propelled member 70 and the traveling face is considerably small. Hence, the self-propelled member 70 can travel considerably smoothly and freely with agility in every direction.

When a plurality of openings are formed in the lower face, the openings are arranged such that a balance is achieved with reference to the center of gravity of the self-propelled member.

A power supply for feeding power to the planar linear motor 73 and the pulse motor 80 of a self-propelled member 70 may be of internal power supply type (i.e., batteries) or external power supply type unless the power supply hinders travel of the self-propelled member on the traveling field. As of now, realization of a power supply using an external power source is considerably difficult. Hence, there is no alternative way but to mount a battery 79 on the self-propelled member 70 as a power source.

Figure 11:
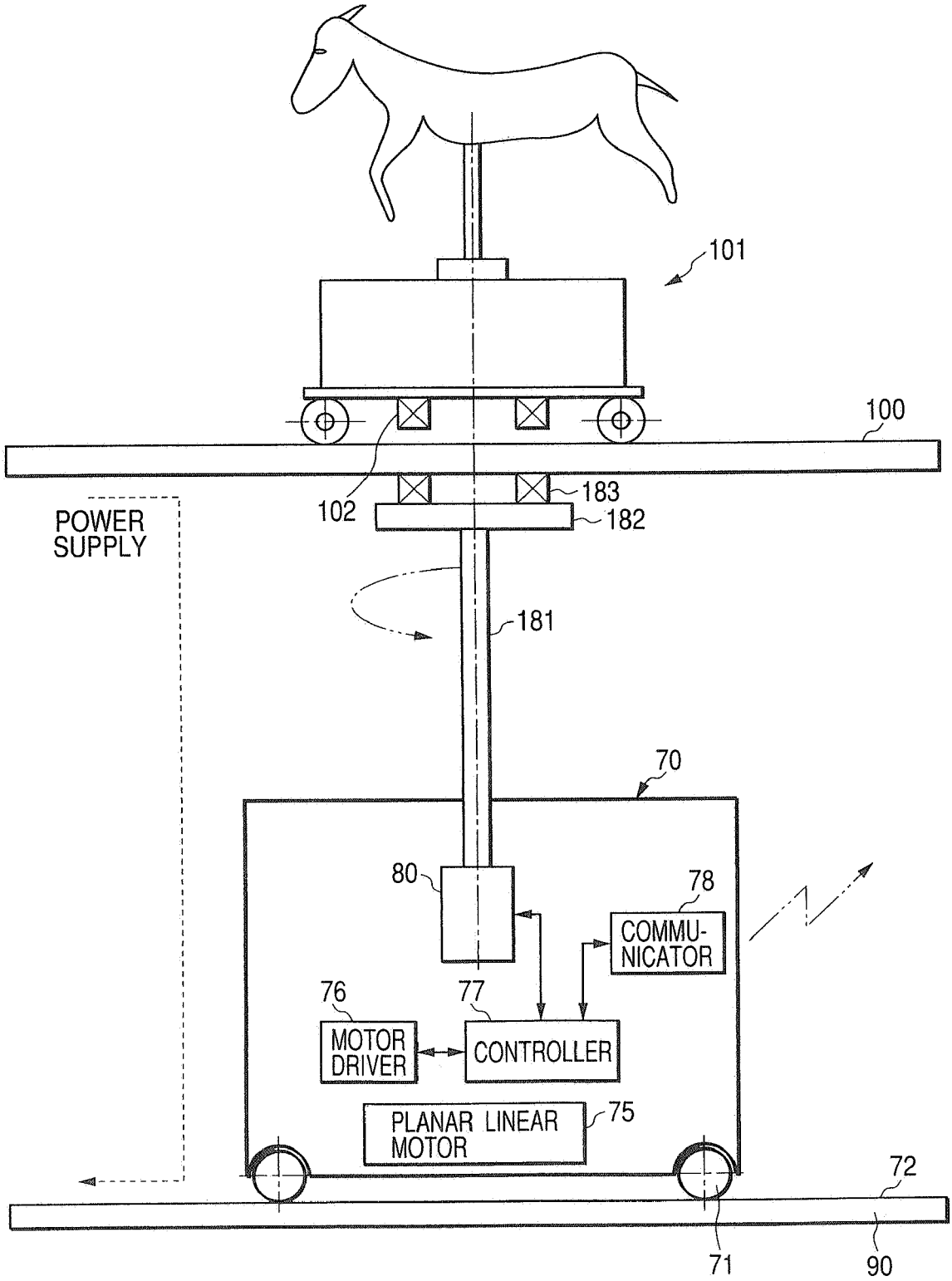
FIG. 11 is a schematic cross-sectional view showing a self-propelled member according to a third embodiment of the present invention.

FIG. 11 shows a third embodiment of the invention which is applied to a racing game. The identical parts or members as described in the above embodiments are designated by the same reference numerals and detailed explanations for such members will be omitted here.

Figure 8:
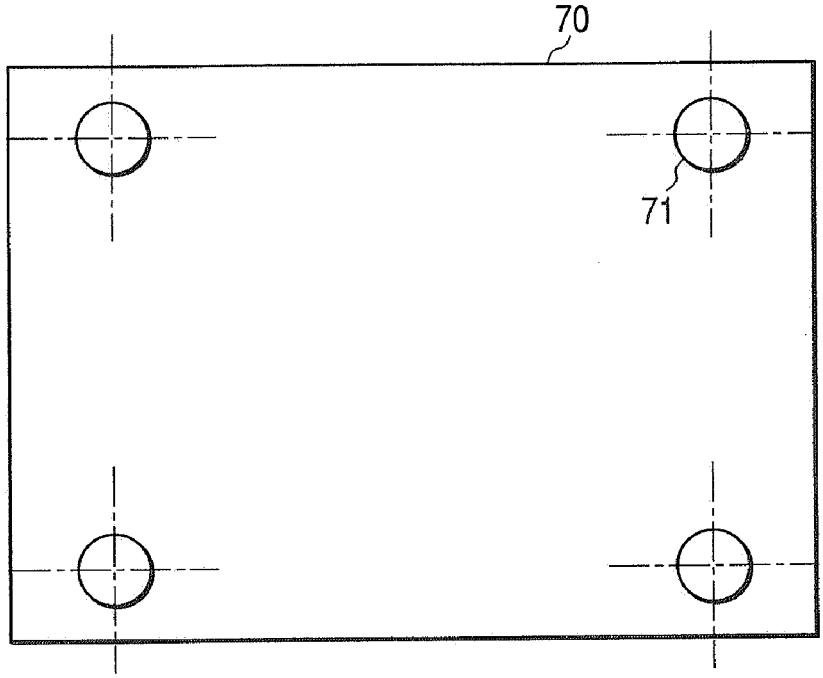
FIG. 8 is a plan view showing the layout of ball bearings of the self-propelled member shown in FIG. 7.

A self-propelled member 70 travels over a traveling field 90 by four ball bearings 71 as shown in FIG. 8. The traveling field 90 is provided with a platen 72 having the same platen dots as those shown in FIG. 2.

Figure 12:
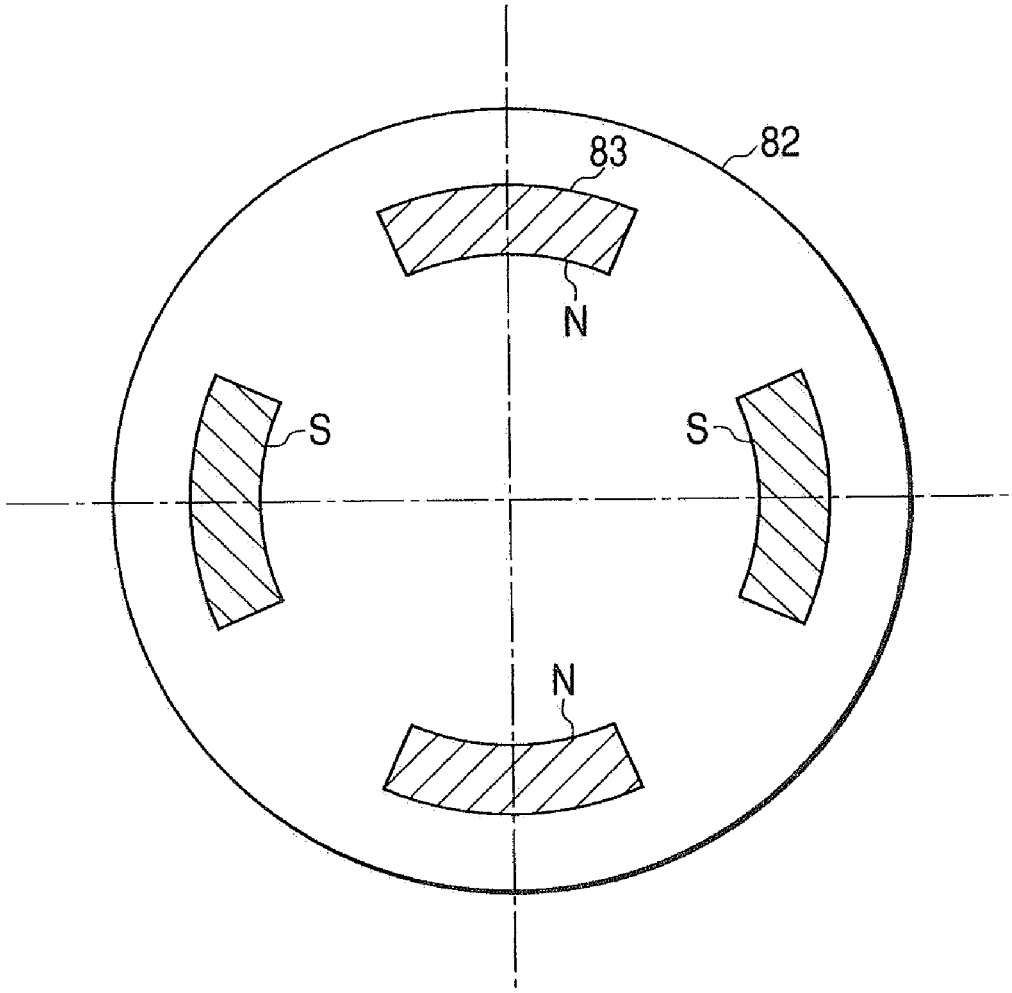
FIG. 12 is a plan view of a guide magnet in the self-propelled member shown in FIG. 11.

A pulse motor 80 for turning purposes is provided in an upper center position of the self-propelled member 70. The pulse motor 80 controls a turning angle of a guide support 181. As shown in FIG. 12, an annular guide magnet 183 constituted by alternately arranging arcuate S-pole magnet and N-pole magnet is fixed on a disk 182 secured on an upper end of the guide support 181.

A guided magnetic substance (a magnet employed in the present embodiment) 102 is fixed on the lower face of a miniature 101, which travels over a racing track 100, so as to oppose the guide magnet 183. The magnets 183 and 102 constitute torque transmission coupling. As a result of turning of the guide magnet 183, the guided magnet 102 undergoes turning torque and is turned. Further, the guided magnet 102 is towed in the traveling direction of the guide magnet 183. The guide magnet 183 is turned, by the pulse motor 80 in accordance with a change in the steering direction of the self-propelled member (i.e., the turning action of the self-propelled member). The miniature is turned by the turning torque and is oriented toward the towing direction of the guide magnet 183.

The turning angle of the pulse motor 80 is defined by a scheduled angular change in the moving direction of the self-propelled member 70 (i.e., an angle through which a self-propelled member is scheduled to turn a direction by a program in accordance with a traveling path of an individual miniature). A distance over which the self-propelled member travels in the X direction and a distance over which the self-propelled member travels in the Y direction are also defined by the scheduled angular change in the moving direction. Consequently, the angle through which the miniature 101 is turned by the pulse motor 80 matches the moving direction of the self-propelled member 70.

A way to compute the turning angle of the pulse motor 80 and the distance over which the self-propelled member 70 travels in the X and Y directions is defined in accordance with the nature of the game machine such that a control program and information processing become simple, as required.

The self-propelled member travels in an arbitrary direction within the X-Y plane without changing its posture (i.e., a front face thereof still directs frontward). The miniature 101 is guided in the same direction as that in which the self-propelled member 70 is moving, by magnetic force originating from the guide magnet 183. On the other hand, the miniature 101 is turned to the guide direction by turning action of the guide magnet 183. Consequently, the miniature member 101 is turned to and runs in the moving direction of the self-propelled member 70.

Control of turning action of the guide magnet 183 can be implemented by a mechanism for directly turning an annular magnet through use of a pulse motor.

Ball bearings of the self-propelled member 70 are made of metal. In order to diminish rotational resistance between the ball bearings and an interior face of a retaining section, the balls are held in the retaining section such that linear or point contact exists between the balls and the retaining section.

In the case of metal ball bearings, the ball bearings can be utilized as power supply terminals, thereby simplifying the construction of a power supply mechanism.

As a matter of course, the bearing configuration as described the above may be replaced with the thrust bearing 110 as shown in FIG. 9.

Figure 13:
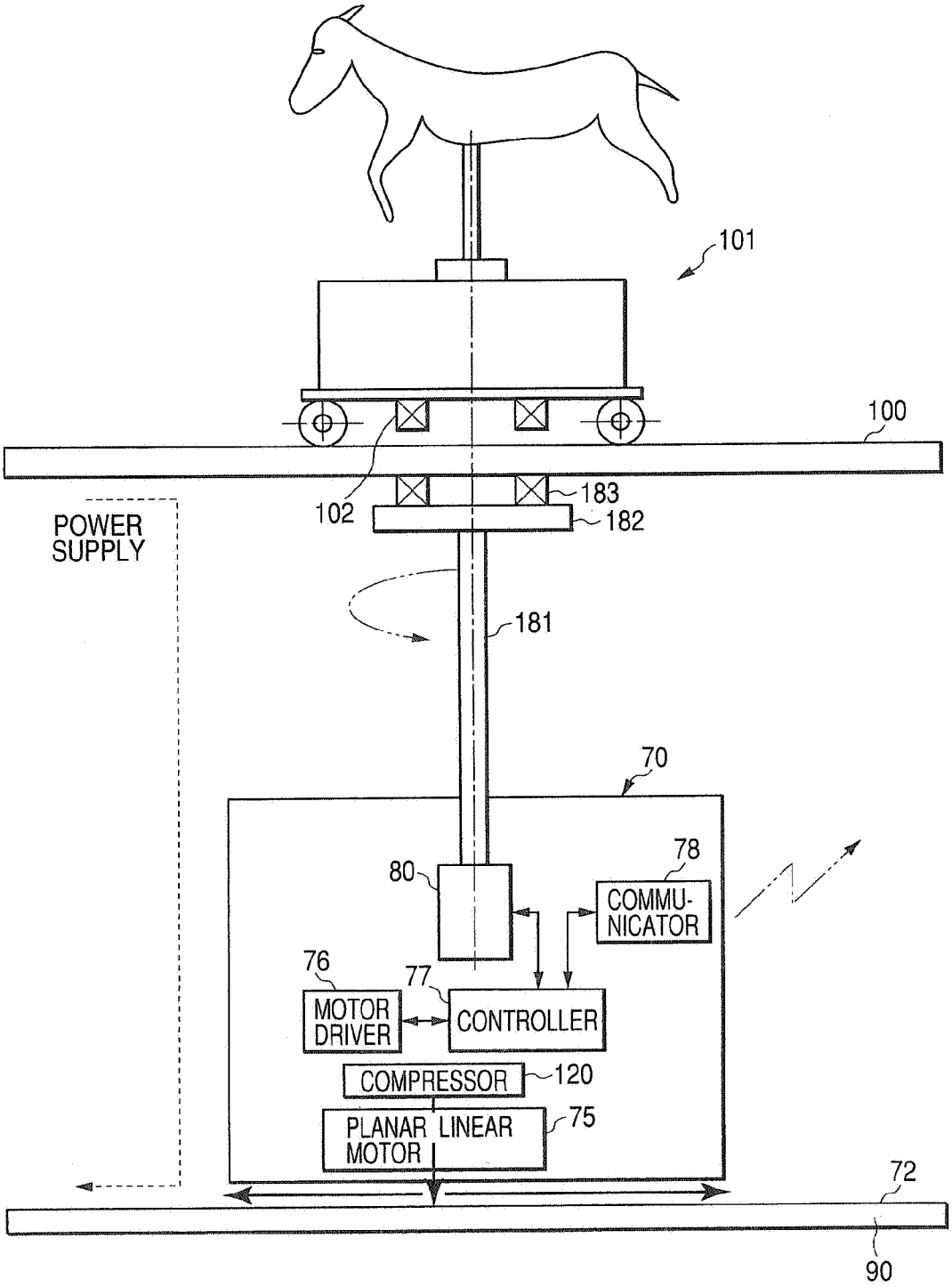
FIG. 13 is a schematic cross-sectional view showing a self-propelled member according to a fourth embodiment of the invention and FIG. 13A illustrates an embodiment where self-propelled member is supported by an air layer.

Further, similarly to the second embodiment, the bearing configuration may be replaced with the air bearing as shown in FIG. 13.

Figure 13A:
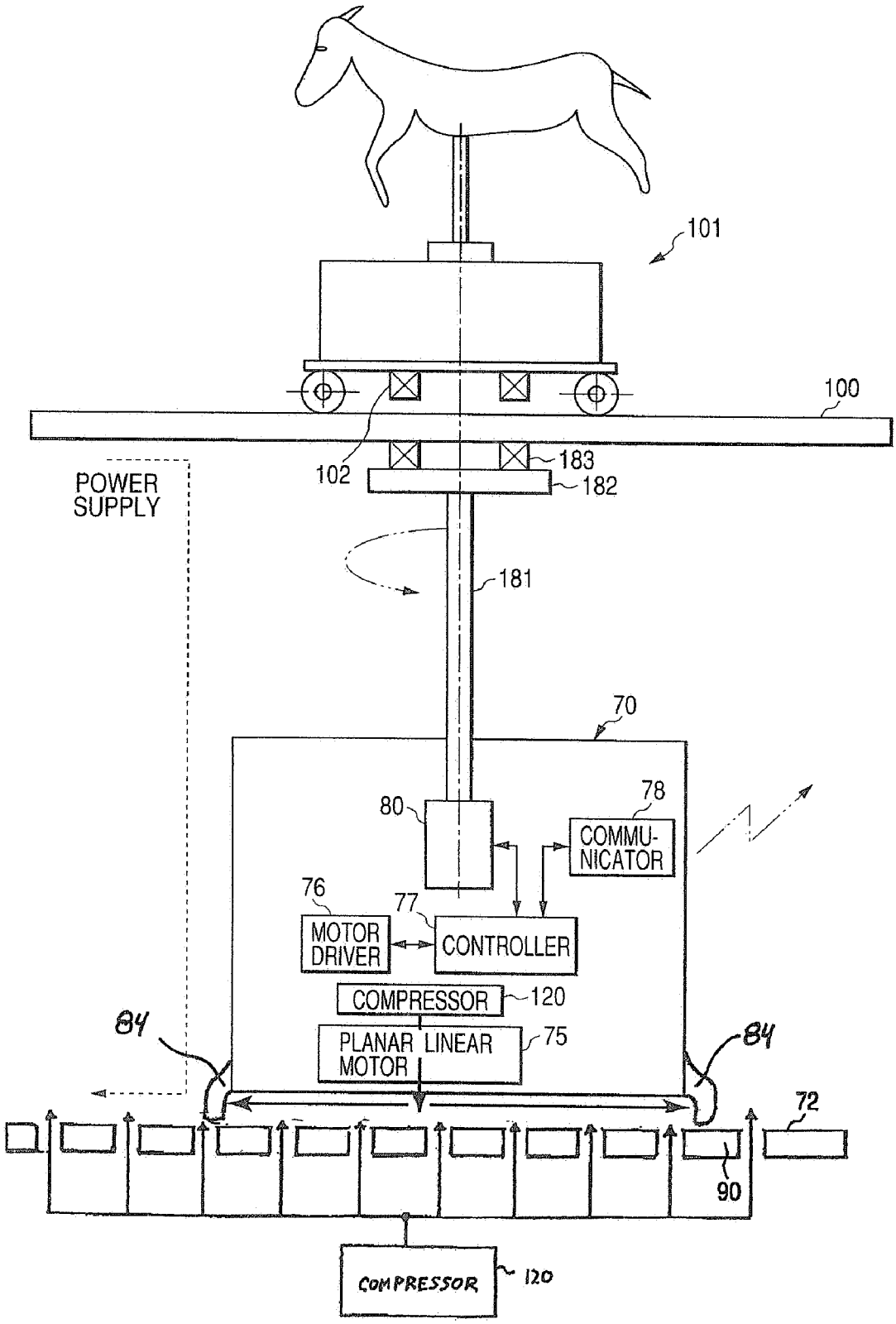

The configuration shown in FIG. 13A may be adopted. In this case, the compressor 120 is disposed below the platen 72. As indicated by arrows in the figure, air from the compressor 120 is blown toward the lower face of the self-propelled member 70 via opening formed in the platen 72 so that the air is caused to flow in every direction along the lower face of the self-propelled member 70. A thin air layer is accordingly formed between the self-propelled member 70 and the traveling face so that the self-propelled member 70 is supported by the air layer. In a case where a skirt member 84 is provided around a circumferential portion of the lower face of the self-propelled member 70, the formation of such an air layer can be facilitated.

A travel control system of a self-propelled member differs in accordance with the nature of a game machine. However, the basic travel control of a self-propelled member is made identical with that of the planar linear motor as described before.

When a plurality of miniature members are caused to race with each other, the traveling paths and speeds of all the self-propelled members are controlled simultaneously in parallel each other by single controller. Further, the turning angles of miniatures of all the self-propelled members are controlled in parallel with each other simultaneously.

Since the self-propelled member is caused to travel by a planar linear motor, the self-propelled member travels accurately in accordance with an instruction in terms of either travel direction or speed. The self-propelled member does not deviate from a scheduled path, which would otherwise be caused by slippage of driving wheels. Hence, self-propelled members do not interfere with each other. Even if interference has arisen between the self-propelled members for any reason, the self-propelled members do not go out of the scheduled traveling paths to such an extent that they become uncontrollable.

For example, when a game is caused to proceed by applying the present invention to a horseracing game machine using ten miniatures, there is a necessity of controlling the ten miniatures in a complicated manner while relating them with each other such that the ten miniatures run in a realistic manner. In order to realize such control operation, travel control data pertaining to individual self-propelled members are set in RAM of the controller beforehand, and all the self-propelled members are concurrently controlled in parallel with each other on the basis of the data.

A method of controlling travel actions of self-propelled members in a horseracing game machine has already been known as described in, e.g., Japanese Patent No. 2650643. A control method for controlling travel actions of self-propelled members in a horseracing game machine is not the gist of the present invention, and hence its explanation is omitted.

Desirably, power to the planar linear motor 73 and the pulse motor 80 of a self-propelled member is externally supplied so as not hinder travel of the self-propelled member on a free track. For this reason, there is employed a power supply system, wherein a lower face of the racing track and an upper face of the traveling field are constituted as conductive planes so that power is supplied to planar linear motors of self-propelled members via the conductive planes (as indicated by dashed lines shown in FIGS. 11 and 13).

As a matter of course, there may also be possible to employ a power supply mechanism, wherein a power supplier is provided on a lower face of the racing track, and current collectors formed on the self-propelled member are brought into slidable contact with the lower face.

In the case of an embodiment shown in FIG. 12, the self-propelled member 70 is minutely levitated from the traveling field. Hence, there is a necessity of some contrivance, such as bringing a brush provided in a lower portion of the self-propelled member into slidable contact with the traveling field.

In view of the basic concept of the present invention, it is also technically possible to provide a rotary motor in a miniature so that only a main body of the miniature is turned on a base member thereof, instead of providing a pulse motor in a self-propelled member so that turning torque is imparted to the miniature through guide magnets. However, this method involves a necessity of providing batteries in the miniature (it is impossible to supply power to the miniature externally), and of housing the rotary motor in the miniature. This will result in a bigger miniature and an increase in the costs of the game machine. Thus, the method is not realistic.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, nozzles from which air is blown toward a bottom face of the self-propelled member may be formed on the lower track to form an air bearing layer between the bottom face and the lower track to support the self-propelled member thereon.

In this configuration, the self-propelled member is supported by an air bearing constituted of a thin air layer. The self-propelled member travels over the lower track while slightly being supported and levitated by the air layer. Consequently, traveling resistance of the self-propelled member is diminished. The self-propelled member can travel freely by small traveling and driving force originating from the planar linear motor.

Here, it is preferable that a skirt member is formed on a peripheral portion of the bottom face of the self-propelled member.

In this configuration, the skirt member effectively captures an air flow blown from the nozzles formed on the traveling field. Hence, the self-propelled member can be slightly levitated from the travel face by a relatively weak air flow from the nozzles.

What is claimed is:

1. A game machine, comprising:

a traveling field, on which platen dots are provided;

a plurality of miniature members: and a plurality of self-propelled members, which are provided on the traveling field, each of the self-propelled members including:

a base body;

a first yoke, provided in a bottom part of the base body to constitute a first linear motor together with the platen dots for propelling the base body in a first direction on the traveling field, while maintaining a direction to which a front face of the base body is directed;

a second yoke, provided in a bottom part of the base body to constitute a second linear motor together with the platen dots for propelling the base body in a second direction which is perpendicular to the first direction, while maintaining the direction to which the front face of the base body is directed;

a motor, having a shaft coupled with an associated one of the miniature members; and a controller, which controls the motor such that a rotated angle of the shaft so that a relative angle between the front face of the base body and a front face of the associated one of the miniature members is varied in accordance with a propelling direction of the base body.

2. The game machine as set forth in claim 1, wherein ball bearings are provided on a bottom face of the self-propelled member to assist the propelling on the traveling field.

3. The game machine as set forth in claim 1, wherein each of the first yoke and the second yoke is formed with three legs provided with coils, to constitute three-phase linear motor.

4. The game machine as set forth in claim 3, wherein a lower end portion of each leg is split into plural projections each having an identical width with a width of each platen dot.

5. The game machine as set forth in claim 2, wherein the ball bearings are composed of at least three independent ball bearings.

6. The game machine as set forth in claim 2, wherein the ball bearings are supported within an annular retainer formed on the bottom face of the self-propelled member to constitute a thrust bearing.

7. The game machine as set forth in claim 1, wherein the motor is a pulse motor.

8. The game machine as set forth in claim 1, wherein nozzles from which air is blown toward a bottom face of the self-propelled member are formed on the traveling field to form an air bearing layer between the bottom face and the traveling field to support the self-propelled member thereon.

9. The game machine as set forth in claim 8, wherein a skirt member is formed on a peripheral portion of the bottom face of the self-propelled member.

10. The game machine as set forth in claim 1, wherein the self-propelled member includes a compressor for blowing compressed air toward the traveling field through nozzles formed on a bottom face thereof, to form an air bearing layer between the bottom face and the traveling field to support the self-propelled member thereon.

11. A self-propelled member which propels on a traveling field provided with platen dots thereon, comprising:

a miniature member;

a base body;

a first yoke, provided in a bottom part of the base body to constitute a first linear motor together with the platen dots for propelling the base body in a first direction on the traveling field, while maintaining a direction to which a front face of the base body is directed;

a second yoke, provided in a bottom part of the base body to constitute a second linear motor together with the platen dots for propelling the base body in a second direction which is perpendicular to the first direction, while maintaining the direction to which the front face of the base body is directed;

a motor, having a shaft coupled with the miniature member; and a controller, which controls the motor such that a rotated angle of the shaft so that a relative angle between the front face of the base body and a front face of the miniature member is varied in accordance with a propelling direction of the base body.

12. The self-propelled member as set forth in claim 11, wherein ball bearings are provided on a bottom face of the self-propelled member to assist the propelling on the traveling field.

13. The self-propelled member as set forth in claim 11, wherein each of the first yoke and the second yoke is formed with three legs provided with coils, to constitute three-phase linear motor.

14. The self-propelled member as set forth in claim 13, wherein a lower end portion of each leg is split into plural projections each having an identical width with a width of each platen dot.

15. The self-propelled member as set forth in claim 12, wherein the ball bearings are composed of at least three independent ball bearings.

16. The self-propelled member as set forth in claim 12, wherein the ball bearings are supported within an annular retainer formed on the bottom face of the self-propelled member to constitute a thrust bearing.

17. The self-propelled member as set forth in claim 11, wherein the motor is a pulse motor.

18. The self-propelled member as set forth in claim 11, wherein an air-flow receiving skirt member is formed on a peripheral portion of a bottom face of the self-propelled member.

19. The self-propelled member as set forth in claim 11, wherein the self-propelled member includes a compressor for blowing compressed air toward the traveling field through nozzles formed on a bottom face thereof, to form an air bearing layer between the bottom face and the traveling field to support the self-propelled member thereon.

20. A racing game machine, comprising:

a racing track;

a traveling field extending below the racing track, on which platen dots are provided;

a plurality of miniature members, which are provided on the racing track to be raced with each other, each of the miniature members provided with a magnetic substance; and a plurality of self-propelled members, which are provided on the traveling field while being associated with the respective miniature members, each of the self-propelled members including:

a base body;

a first yoke, provided in a bottom part of the base body to constitute a first linear motor together with the platen dots for propelling the base body in a first direction on the traveling field, while maintaining a direction to which a front face of the base body is directed;

a second yoke, provided in a bottom part of the base body to constitute a second linear motor together with the platen dots for propelling the base body in a second direction which is perpendicular to the first direction, while maintaining the direction to which the front face of the base body is directed;

a guide magnet, which constitutes a torque transmission coupling with the magnetic substance of an associated one of the miniature members through the racing track;

a motor, having a shaft couple with the guide magnet; and a controller, which controls the motor such that a rotated angle of shaft so that a relative angle between the front face of the base body and a front face of the associated one of the miniature members is varied in accordance with a propelling direction of the base body.

21. The game machine as set forth in claim 20, wherein ball bearings are provided on a bottom face of the self-propelled member to assist the propelling on the traveling field.

22. The game machine as set forth in claim 20, wherein each of the first yoke and the second yoke is formed with three legs provided with coils, to constitute three-phase linear motors.

23. The game machine as set forth in claim 22, wherein a lower end portion of each leg is split into plural projections each having an identical width with a width of each platen dot.

24. The game machine as set forth in claim 21, wherein the ball bearings are composed of at least three independent ball bearings.

25. The game machine as set forth in claim 21, wherein the ball bearings are supported within an annular retainer formed on the bottom face of the self-propelled member to constitute a thrust bearing.

26. The game machine as set forth in claim 20, wherein each of the guide magnet of the self-propelled member and the magnetic substance of the miniature member is composed of arcuate N-pole magnets and arcuate S-pole magnets which are arranged alternately and annularly.

27. The game machine as set forth in claim 20, wherein the motor is a pulse motor.

28. The game machine as set forth in claim 20, wherein nozzles from which air is blown toward a bottom face of the self-propelled member are formed on the traveling field to form an air bearing layer between the bottom face and the traveling field to support the self-propelled member thereon.

29. The game machine as set forth in claim 28, wherein a skirt member is formed on a peripheral portion of the bottom face of the self-propelled member.

30. The game machine as set forth in claim 20, wherein the self-propelled member includes a compressor for blowing compressed air toward the traveling field through nozzles formed on a bottom face thereof, to form an air bearing layer between the bottom face and the traveling field to support the self-propelled member thereon.

31. The game machine as set forth in claim 20, wherein the magnetic substance of the miniature member is divided magnetic poles forming an induced magnet.

32. The game machine as set forth in claim 21, wherein:

the ball bearings are made of metal, and a conductive layer is formed on the traveling field for supplying electric power to the linear motors of the self-propelled member via the ball bearings.

33. A self-propelled member which propels on a traveling field provided with platen dots thereon, comprising:

a miniature member, which is provided with a magnetic substance and adapted to be provided on a racing track extending above the racing track;

a base body;

a first yoke, provided in a bottom part of the base body to constitute a first linear motor together with the platen dots for propelling the base body in a first direction on the traveling field, while maintaining a direction to which a front face of the base body is directed;

a second yoke, provided in a bottom part of the base body to constitute a second linear motor together with the platen dots for propelling the base body in a second direction which is perpendicular to the first direction, while maintaining the direction to which the front face of the base body is directed;

a guide magnet, which constitutes a torque transmission coupling with the magnetic substance of the miniature member through the racing track;

a motor, having a shaft coupled with the guide magnet; and a controller, which controls the motor such that a rotated angle of the shaft so that a relative angle between the front face of the base body and a front face of the miniature member is varied in accordance with a propelling direction of the base body.

34. The self-propelled member as set forth in claim 33, wherein ball bearings are provided on a bottom face of the self-propelled member to assist the propelling on the traveling field.

35. The self-propelled member as set forth in claim 33, wherein each of the first yoke and the second yoke is formed with three legs provided with coils, to constitute three-phase linear motors.

36. The self-propelled member as set forth in claim 35, wherein a lower end portion of each leg is split into plural projections each having an identical width with a width of each platen dot.

37. The self-propelled member as set forth in claim 34, wherein the ball bearings are composed of at least three independent ball bearings.

38. The self-propelled member as set forth in claim 34, wherein the ball bearings are supported within an annular retainer formed on the bottom face of the self-propelled member to constitute a thrust bearing.

39. The self-propelled member as set forth in claim 33, wherein each of the guide magnet of the self-propelled member and the magnetic substance of the miniature member is composed of arcuate N-pole magnets and arcuate S-pole magnets which are arranged alternately and annularly.

40. The self-propelled member as set forth in claim 33, wherein the motor is a pulse motor.

41. The self-propelled member as set forth in claim 33, wherein an air-flow receiving skirt member is formed on a peripheral portion of a bottom face of the self-propelled member.

42. The self-propelled member as set forth in claim 33, wherein the self-propelled member includes a compressor for blowing compressed air toward the traveling field through nozzles formed on a bottom face thereof, to form an air bearing layer between the bottom face and the traveling field to support the self-propelled member thereon.

43. The game machine as set forth in claim 33, wherein the magnetic substance of the miniature member is divided magnetic poles forming an induced magnet.

44. The game machine as set forth in claim 34, wherein the ball bearings are made of metal, through which electric power is supplied to the linear motors.

* * * * *